United States Patent [19]

Sawamoto

[11] Patent Number: 4,495,921

[45] Date of Patent: Jan. 29, 1985

[54] ELECTRONIC CONTROL SYSTEM FOR AN INTERNAL COMBUSTION ENGINE CONTROLLING AIR/FUEL RATIO DEPENDING ON ATMOSPHERIC AIR PRESSURE

[75] Inventor: Kunifumi Sawamoto, Yokosuka, Japan

[73] Assignee: Nissan Motor Company, Limited, Yokohama, Japan

[21] Appl. No.: 351,901

[22] Filed: Feb. 24, 1982

[30] Foreign Application Priority Data

Mar. 10, 1981 [JP] Japan ..... 56-33062

[51] Int. Cl.[3] ..... F02M 7/00

[52] U.S. Cl. ..... 123/438; 123/480

[58] Field of Search ..... 123/435, 438, 440, 436, 123/480, 489, 478

[56] References Cited

U.S. PATENT DOCUMENTS

| | | | |
|---|---|---|---|
| 4,167,924 | 9/1979 | Carlson et al. | 123/440 |
| 4,364,227 | 12/1982 | Yoshida et al. | 123/440 |
| 4,365,603 | 12/1982 | Shikata et al. | 123/440 |
| 4,373,187 | 2/1983 | Ishii et al. | 123/480 |

*Primary Examiner*—Parshotam S. Lall
*Assistant Examiner*—W. R. Wolfe
*Attorney, Agent, or Firm*—Schwartz, Jeffery, Schwaab, Mack, Blumenthal & Koch

[57] ABSTRACT

An air fuel ratio control system includes a correction system for correcting air/fuel ratio depending on measured atmospheric air pressure. The correction system has sensors for detecting engine operating conditions. A reference intake manifold pressure corresponding to the detected engine operating condition at sea level is obtained from the engine operating condition. The reference atmospheric air pressure is compared with the measure intake manifold absolute pressure to determine a difference value. Based on the difference, a correction value for controlling the air/fuel ratio is determined.

17 Claims, 9 Drawing Figures

ELECTRONIC CONTROL SYSTEM FOR AN INTERNAL COMBUSTION ENGINE CONTROLLING AIR/FUEL RATIO DEPENDING ON ATMOSPHERIC AIR PRESSURE

BACKGROUND OF THE INVENTION

The present invention relates generally to an air/fuel ratio control system for an internal combustion engine. More particularly, the invention relates to a system for correcting the air/fuel ratio of the engine depending upon measured atmospheric pressure.

Generally, fuel is metered into a mixture supply in an induction passage of the internal combustion engine so that the metered fuel amount is proportional to an intake air flow rate in order to keep the air/fuel mixture ratio at a satisfactory value corresponding to engine operating conditions. For modern vehicle engines, catalytic converters are provided which operate to define a range of the air/fuel ratios for preventing or limiting the emission of CO, NOx, etc., in the exhaust gas. In other words, the air/fuel ratio of the mixture is controlled in a range where the catalytic converter works effectively.

As is well known, since the air/fuel ratio is controlled by controlling the fuel metered amount in relation to the amount of air supplied to the mixture supply, the fuel amount to be metered is varied depending not only on the intake air flow rate but also on atmospheric air pressure. Particularly in mountainous areas, atmospheric pressure varies depending on vehicle elevation and thus the intake air amount is varied with respect to that of the metered fuel. In order to keep the mixture within the effective range of the catalytic converter, it is, therefore, required to correct the fuel metering amount depending on atmospheric air pressure.

Conventionally, such correction is effected by a mechanical device, such as a pressure responsive diaphragm actuator. Since such mechanical correction involves significant time lag, it permits the mixture to temporarily be too rich for the efficient operation of the catalytic converter.

Further, the mechanical correction device, such as a diaphragm actuator, cannot follow the relatively delicate variation of atmospheric air pressure. Therefore, such conventional correction devices are not accurate for satisfactory engine control. In addition, a conventional mechanical device is apt to vary in its response characteristics while it is used in engine control over a relatively long period of time. This response variation and lacking of durability are disadvantageous and inconvenient and requires periodic maintenance or adjustment of the mechanical device.

SUMMARY OF THE INVENTION

Therefore, it is an object of the invention to provide a fuel metering control system with an atmospheric air pressure dependent correction which can be performed accurately and durably.

This principle object and other objects of the invention are achieved utilizing an electronic correction system including a microcomputer. In the correction device according to the invention, the atmospheric air pressure indicative parameter, such as the absolute pressure in the engine intake manifold, is sequentially compared with a reference value which defines a reference pressure corresponding to the atmospheric air pressure at sea level. Based on the difference of the measured absolute intake vacuum and the reference value, a correction coefficient for the fuel metering amount is determined.

BRIEF DESCRIPTION OF THE DRAWINGS

The present invention will be understood more fully from the detailed description of the invention given herebelow and from the accompanying drawings of the preferred embodiments of the present invention which, however, should not be taken as limitative of the invention but rather for elucidation and explanation only.

In the drawings.

DESCRIPTION OF THE PREFERRED EMBODIMENTS

Figure 1:
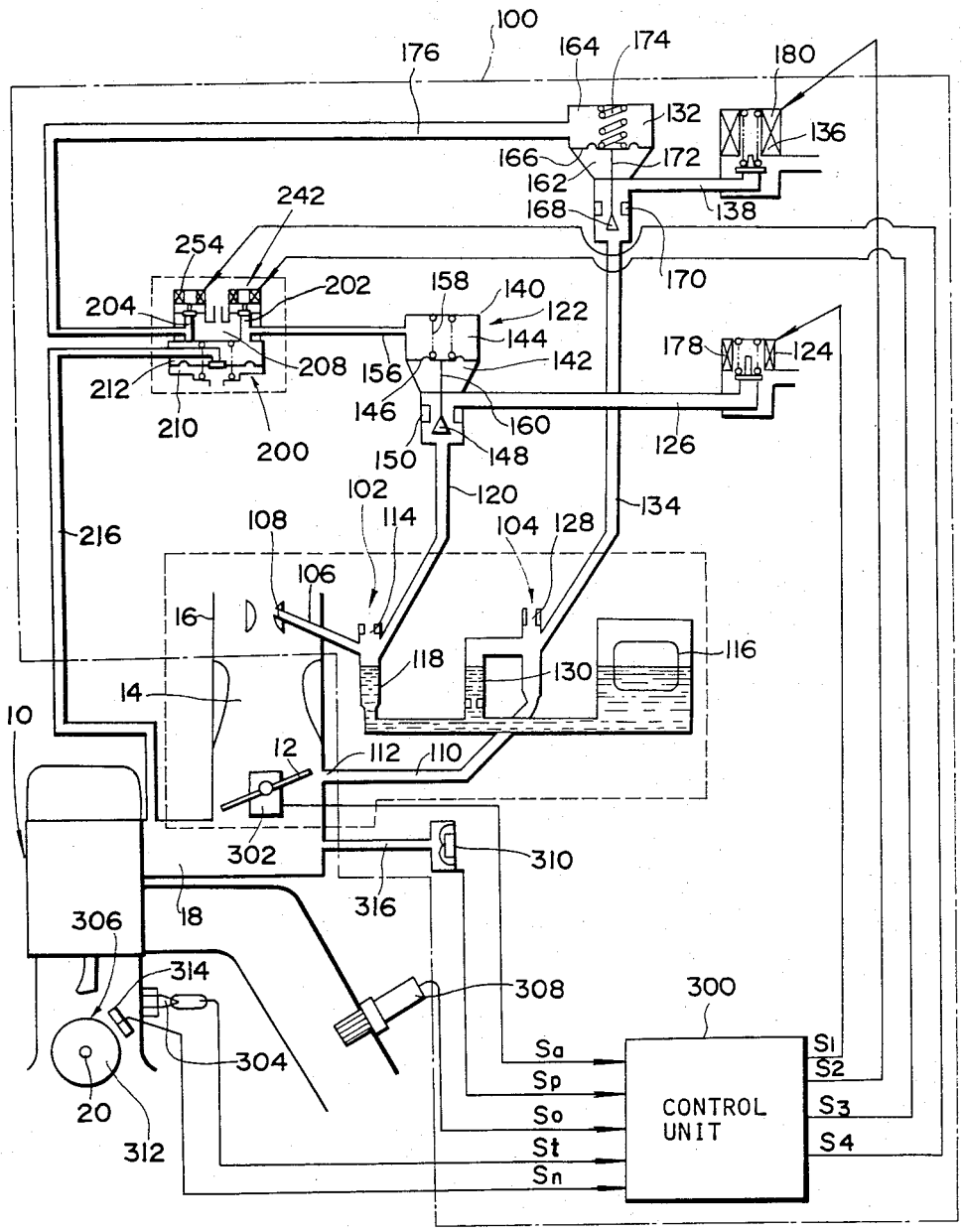
FIG. 1 is a fragmental diagramatic illustration of an internal combustion engine having electronically controlled carburetor with a first embodiment of a control system according to the present invention.

Referring now to the drawings, particularly to FIG. 1, there is illustrated an internal combustion engine 10 with an electronically controlled carburetor 100. The electronically controlled carburetor 100 generally comprises a main mixture supply system 102 and a slow mixture supply system 104. The main mixture supply system 102 includes a main mixture delivery nozzle 106 having a mixture discharging end 108 opening upstream of a throttle valve 12 in a venturi portion 14 of an induction passage 16 of the engine. The slow mixture supply system 104 includes a slow mixture delivery nozzle 110 having a mixture discharging end 112 opening to the venturi portion 14 of the induction passage 16 at a position approximately adjacent the throttle valve 12.

The main mixture supply system 102 has a main variable air bleeder 114 in which a main air/fuel mixture is created. The main variable air bleeder 114 is connected with a float chamber 116 via a main fuel passage 118 and, in turn, connected with a main air passage 120. A vacuum actuated main air control valve 122 is provided in the main air passage 120. The main air control valve 122 delivers main air to the main variable air bleeder 114 at a controlled amount. The main air is introduced into control valve 122 via an electromagnetically controlled valve 124 and through an air passage 126. The electromagnetically controlled valve 124 has a per se well known construction and functions to control the main air flow amount delivered via the main air control valve 122.

Similar to the main mixture supply system, the slow mixture supply system 104 has a slow variable air bleeder 128 in which a slow air/fuel mixture is created. The slow variable air bleeder 128 is associated with a slow fuel passage 130 which is connected to the float chamber 116. The slow variable air bleeder 128 is, in turn, connected to a vacuum actuated slow air control valve 132 via a slow air passage 134. The slow air control valve 132 introduces slow air via an electromagnetically controlled valve 136 and through an air passage 138. The electromagnetically controlled valve 136 has per se well known construction and function to deliver a controlled amount of the slow air.

The main air control valve 122 defines therein chambers 142 and 144 in the valve housing 140, which chambers are separated by an elastically deformable diaphragm 146. The chamber 142 is located in the main air passage 120. A main air control valve member 148 is movably disposed within the chamber 142 so that it may move to and fro with respect to a valve seat 150 provided at the end of the main air passage 120. The chamber 142 is, in turn, connected to the electromagnetically controlled valve 124 to introduce therefrom the controlled amount of main air. The valve member 148 together with the valve seat 150 constitute a throttle for controlling the main air flow amount to be delivered to the main variable air bleeder 114. On the other hand, the chamber 144 communicates with a chamber 202 of a vacuum regulator valve 200 to introduce therein a constant pressure of regulated vacuum via a vacuum passage 156. Depending on the vacuum pressure, the diaphragm 146 is deformed against a initial force provided by a spring 158 disposed within the chamber 144. The deformation of the diaphragm 146 is transmitted to the valve member 148 via a valve stem 160 to control throttling ratio of the main air delivered to the main variable air bleeder 114.

Similarly to the above, the slow air control valve 132 defines therein two chambers 162 and 164 separated by an elastically deformable diaphragm 166. The chamber 162 communicates with the slow air passage 134. A slow air control valve member 168 is disposed within the chamber 162 to constitute a throttle with a valve seat 170 provided at the end of the slow air passage 124 to throttle the slow air to be delivered to the slow variable air bleed 128. In turn, the chamber 162 introduces the controlled amount of slow air from the electromagnetically controlled valve 136 via the air passage 138. The valve member 168 is associated with the diaphragm 166 via a valve stem 172 so that it may move to and fro with respect to the valve seat 170 in response to the deformation of the diaphragm. On the other hand, the chamber 164 houses a spring 174 to provide the diaphragm 166 with the initial force. The chamber 164 communicates with a chamber 204 of the pressure regulator valve 200 to introduce therefrom constant pressure of regulated vacuum via a vacuum passage 176 to control the throttling ratio of the valve member 168 and the valve seat 170.

Figure 2:
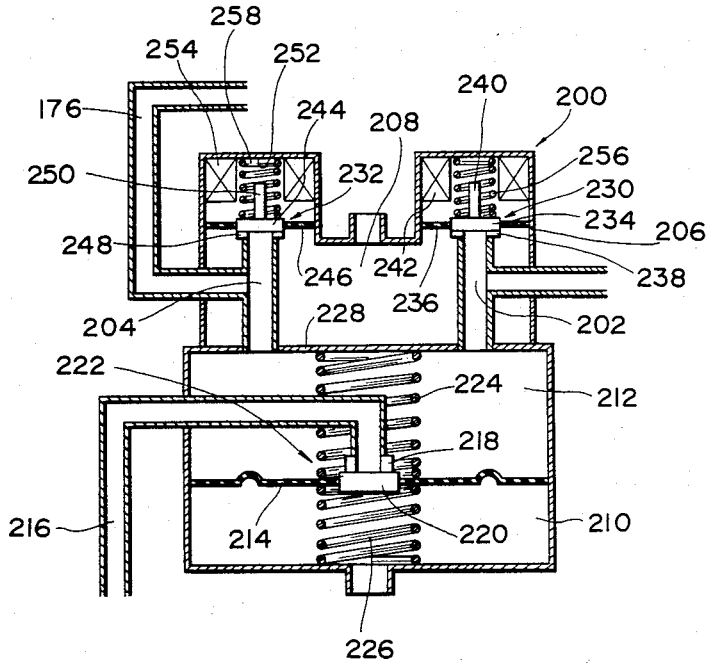
FIG. 2 is a sectional view of a pressure regulating valve for use with the control system of FIG. 1.

As shown in FIG. 2, the pressure regulator valve 200 has a valve housing 206 defining therein chambers 202, 204, 208, 210 and 212. The chambers 208 and 210 are exposed to atmospheric air. The chamber 212 is separated from the chamber 210 by a vacuum responsive diaphragm 214. The chamber 212 communicates with an intake manifold 18 of the induction passage 16 via a induction pipe 216 to introduce intake vacuum of the intake manifold 18 thereinto. The induction pipe 216 is provided with a valve seat 218 at the end thereof communicating into the chamber 212. The valve seat 218 faces a valve member 220 secured onto the diaphragm 214 to constitute a vacuum control valve 222. The diaphragm 214 is biased by springs 224 and 226 disposed within the respective chambers 212 and 210. The spring forces of the springs 224 and 226 are adapted to alternatively and repeatedly open and close the vacuum control valve 222 depending upon the pressure difference between the chambers 212 and 210. On the other hand, the chamber 212 is separated from the chamber 208 by a rigid partition 228. The chambers 202 and 204 are of cylindrical configuration to have ends opening to the chamber 212 through the partition 228. The chambers 202 and 204 also communicate with the chamber 208 via regulation valves 230 and 232. The regulation valve 230 comprises a valve member 234 secured onto a elastically deformable diaphragm 236 and a valve seat 238 provided at the end of the chamber 202. The valve member 234 has a electrically conductive stem inserted into a space defined by an electromagnetically operated actuator 242. Likewise, the regulation valve 232 comprises a valve member 244 secured onto an elastically deformable diaphragm 246 and a valve seat 248 provided at the end of the chamber 204. The valve member 244 has a electrically conductive stem 250 inserted into a space 252 defined by an electromagnetically operated actuator 254. The valve members 234 and 244 are normally urged toward their respective valve seats 238 and 248 via springs 256 and 258 to close the regulation valves 230 and 232 and are adapted to open in response to energization of the actuators 242 and 254.

Returning to FIG. 1, the electromagnetically controlled valves 124 and 136 include electromagnetically operated actuators 178 and 180 which are respectively adapted to be controlled by a control unit 300. The control unit 300 also controls the electromagnetically operated actuators 242 and 254 of the pressure regulator valve 200. The control unit 300 determines duty cycles of control signals to be fed to respective actuators 178, 180, 242 and 254 based on preselected control parameters. In order to enable the control unit 300 to perform control, a throttle angle sensor 302, an engine temperature sensor 304, a crank angle sensor 306, a oxygen sensor 308 and a pressure sensor 310 are provided to detect the engine operating condition. The throttle angle sensor 306 is adapted to detect an angular position of the throttle valve 12. Generally, a potentiometer mechanically connected with the throttle valve 12 or an accelerator pedal (not shown) is used as the throttle valve. The throttle angle sensor 306 produces a throttle angle signal Sa having a signal value A proportional to the throttle valve 12 open angle. The engine temperature sensor 304 is adapted to determine an engine temperature condition and produces an engine temperature signal $S_t$ having value T representative of the determined engine temperature. The engine temperature sensor can be replaced with an engine coolant temperature sensor adapted to determine a coolant temperature in the water jacket of the engine block. The crank angle sensor 306 is adapted to detect the angular position of the crank shaft 20. The crank angle sensor 306 includes a rotary disc 312 rotating with the crank shaft 20 and an electromagnetic pick-up 314. The electromagnetic pick-up 314 produces a crank standard angle signal per every predetermined crankshaft rotational angle, e.g., 1 degree and a crank reference angle signal per every predetermined crank shaft rotational position, e.g., 120 degree. The crank angle sensor 306, thereby, produces a pulsed engine speed signal $S_N$ having a frequency, N, proportional to the engine revolution speed. The oxygen sensor 308 is provided in an exhaust passage 22 of the engine to detect oxygen concentration in the exhaust gas. Generally, the oxygen sensor 308 is adapted to detect presence of oxygen in the exhaust gas to produce an oxygen signal $S_o$. Finally, the pressure sensor 310 is adapted to determine an intake manifold absolute pressure and produces a pressure signal $S_p$ having value P proportional to the intake manifold absolute pressure. Thus, the pressure sensor 310 is communicated to the intake manifold 18 of the induction passage 16 via a vacuum pipe 316.

The control unit 300 determines the duty cycles of control signals $S_1$, $S_2$, $S_3$ and $S_4$ respectively fed to the actuators 178, 180, 242 and 254 based on the foregoing parameters. Under stable engine driving conditions in which the engine is neither accelerated nor decelerated and the engine is not idling, the duty cycles of the control signals $S_1$ and $S_2$ to be fed to the actuators 178 and 180 of the electromagnetically controlled valves 124 and 136 of the main and slow mixture supply system 102 and 104 are determined based on the oxygen signal $S_o$ to control the air/fuel ratio of the air/fuel mixture delivered through the delivery nozzle 106 and 110 at a stoichiometric value. Under the engine idling condition, the duty cycle of the control signal $S_2$ is determined as similar to the above based on the oxygen signal value. On the other hand, if the engine is accelerated or decelerated, or the engine is in a cold engine condition in which the catalytic converter may not work effectively, the control unit 300 determines the duty cycles of the control signals $S_1$ and $S_2$ by an OPEN-LOOP method. Table data for OPEN-LOOP control is stored in a memory of the control unit 300 and read out based on the values of preselected control parameters.

In CLOSED-LOOP control, based on the oxygen signed $S_o$, the air/fuel ratio must be strictly controlled within a range where the catalytic convertor works effectively. The control unit can control the air/fuel ratio at the stoichiometric value by adjusting the air flow amount to be fed to the main and/or slow variable air bleeder 114 and 128 within a relatively small range. The control system of the invention can effect required large changes of the air/fuel ratio resulting from significant changes of atmospheric air pressure. Such significant change of the atmospheric air pressure may occur, for example, during driving through relatively high mountaineous area. If the atmospheric air pressure is abruptly changed during CLOSED-LOOP control, the air/fuel ratio becomes too rich for the catalytic converter to effectively work. This will lead to damage of the catalytic converter and will cause pollution of the atmosphere. Therefore, the control system according to the present invention is adapted to correct the A/F control value depending upon the difference of actual atmospheric pressure and that of sea level.

Figure 3:
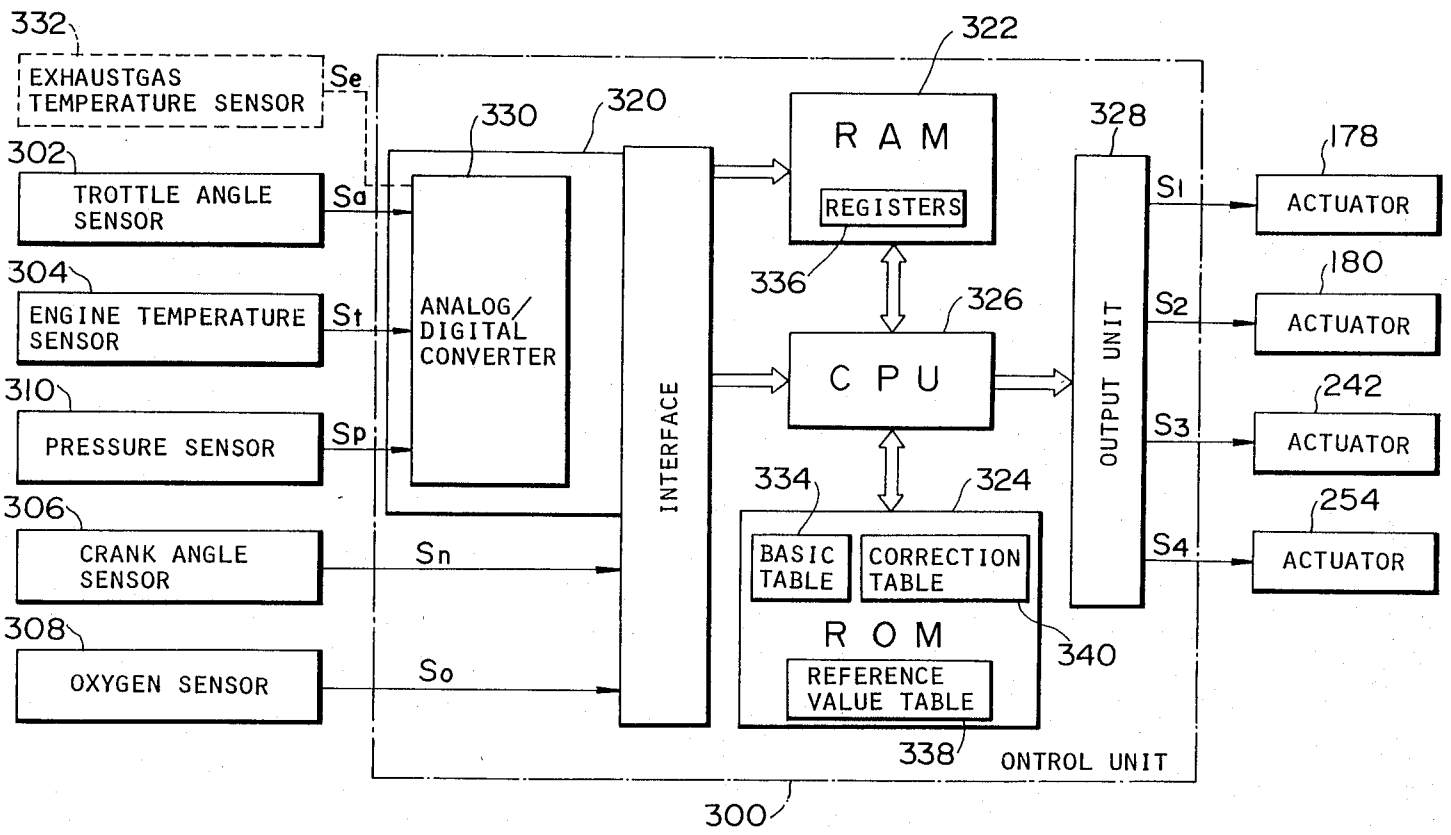
FIG. 3 is a block diagram of the control system of FIG. 1.

FIG. 3 shows diagramatical illustration of the control system of the invention. The control unit 300 comprises a microcomputer including an interface 320, RAM 322, ROM 324, CPU 326 and an output unit 328. The throttle angle signal $S_a$, the engine temperature signal $S_t$ and the pressure signal $S_p$ are inputted to the control unit 300 via an analog/digital converter 330 foming part of the interface 320. In the actual control of the air/fuel ratio, an exhaust gas temperature signal $S_e$ having an analog value proportional to the exhaust gas temperature is fed from an exhaust gas temperature sensor 332 is inputted to the control unit 300 via the analog/digital converter 330. Based on the engine temperature signal $S_t$ and/or the exhaust gas temperature signal $S_e$, the CPU distinguishes whether the engine condition is to be adapted for CLOSED-LOOP control or OPEN-LOOP control. If the engine condition is adapted for CLOSED-LOOP control, the control unit 300 performs per se well known control operation to control the air/fuel ratio based on the oxygen signal $S_o$ fed from the oxygen sensor 308 and, thus, produces control signals $S_1$ and $S_2$ to be fed to the actuators 178 and 180. On the other hand, if the engine condition is adapted for OPEN-LOOP control, the duty cycles of the control signals $S_1$ and $S_2$ are determined based on the throttle angle signal $S_a$ and the engine speed signal $S_N$ respectively fed from the throttle angle sensor 302 and the crank angle sensor 306. The CPU 326 reads out the duty cycle from a look up table stored in a section 334 of the ROM 324 with respect to the throttle angle signal value A and the engine speed signal value N. The duty cycle of the OPEN-LOOP control signals $S_1$ and/or $S_2$ may be corrected in relation to other parameters such as the engine temperature signal $S_t$.

It should be understood that though the throttle angle signal $S_a$ is used for indicating a load condition on the engine in this embodiment, this can be replaced with other signals representative of the engine load, such as, for example, an intake air flow rate.

Figure 4:
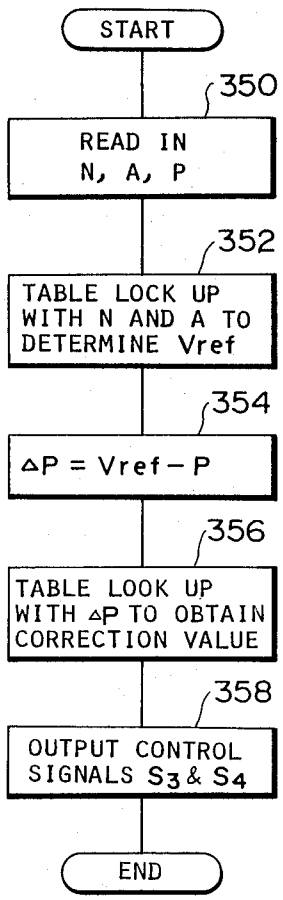
FIG. 4 is a flowchart of a control program to be executed by the control system of FIG. 1, in which is shown a correction program for correcting the air flow amount to be supplied to main and slow air bleeders.

In order to control the air/fuel ratio in relation to the atmospheric air pressure, the CPU determines duty cycles of control signals $S_3$ and $S_4$ to be fed to the actuators 342 and 354 based on the difference of measured intake manifold absolute pressure which is represented by the pressure signal $S_p$. As shown in FIG. 4, the CPU executes a program for controlling the opening and closing of the pressure regulating valve 200. The CPU may, for example, execute the program of FIG. 4 at periodic intervals for example, in synchronism with the engine revolution. At a block 350, the value of the engine speed signal $S_N$, the value A of the throttle angle signal $S_a$ and the value P of the pressure signal $S_p$ are read into a set of registers 336 in the RAM 322. The engine speed signal value N and the throttle angle signal A are read out from the register 336 at a next block 352. The CPU 326 effects table look up with respect to the engine speed signal value N and the throttle angle signal value A to determine a reference value $V_{ref}$ which is representative of the intake manifold absolute pressure of the engine operating condition defined by the engine speed and the throttle angle position at sea level. The look up table is stored in a section 338 of the ROM 324. In the preferred embodiment, a relationship of the reference intake manifold absolute value represented by the reference value, and the engine speed and the throttle angle position is presetted as the following table.

| N(rpm) | A (°) 10 | 20 | 30 | 40 | 50 | 60 | 70 | 80 |
|---|---|---|---|---|---|---|---|---|
| | mmHg | | | | | | | |
| 800 | 510 | 680 | 740 | 744 | 748 | 752 | 756 | 760 |
| 1600 | 310 | 560 | 680 | 730 | 737 | 744 | 752 | 755 |
| 2400 | 210 | 460 | 610 | 660 | 680 | 700 | 718 | 736 |
| 3200 | 160 | 360 | 535 | 610 | 660 | 700 | 715 | 729 |
| 4000 | 160 | 310 | 460 | 560 | 610 | 680 | 715 | 726 |
| 4800 | 160 | 260 | 410 | 510 | 610 | 670 | 710 | 712 |
| 5600 | 160 | 210 | 360 | 460 | 605 | 660 | 700 | 705 |
| 6400 | 160 | 210 | 310 | 410 | 600 | 650 | 700 | 700 |

N (rpm): Engine Speed
A (°): Throttle Valve Open Angle

Figure 5:
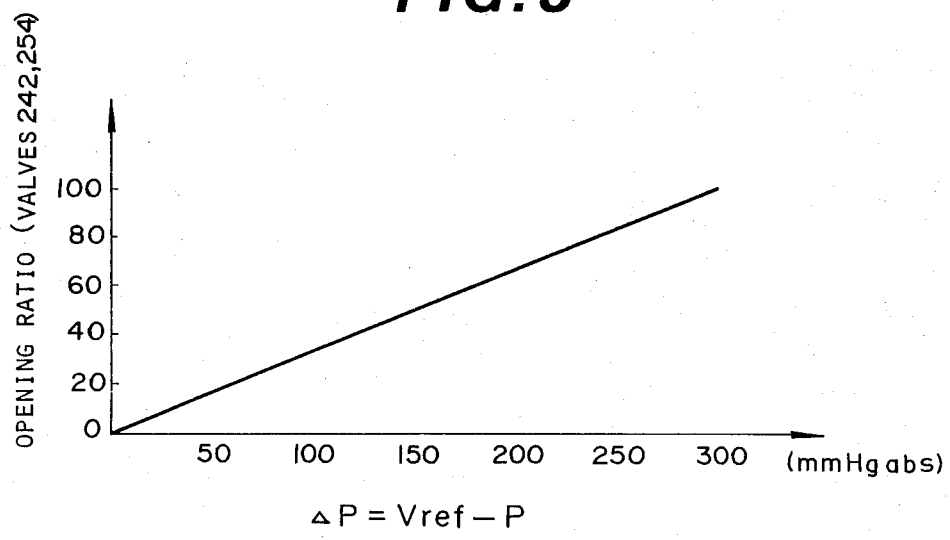
FIG. 5 is a graph showing the relationship of the pressure difference between a measured intake manifold absolute pressure represented by a pressure signal value P and a reference value $V_{ref}$ which corresponds to the intake manifold absolute pressure at an area of 0 m level height.

The determined reference value $V_{ref}$ is comapared with the pressure signal value P read out from the register 336 at a block 354. A difference ΔP of the reference value $V_{ref}$ and the pressure signal value P is thus obtained at the block 354. The CPU 326 effects a table look up with respect to the obtained difference ΔP to determine a correction value (the open time ratios of both values 242 and 254) according to the characteristic as shown in FIG. 5, at a block 356. The table storing the correction values as illustrated in FIG. 5 is stored in a section 340 of the ROM and is read out with respect to the pressure difference ΔP. Based on the determined correction value, the CPU 326 produces the control signals $S_3$ and $S_4$ having duty cycles respectively representative of the determined correction value. The control signals $S_3$ and $S_4$ are fed to the actuators 242 and 254 via the output unit 328 to control the ratio of energized period and deenergized period of the actuators 242 and 254, at block 358. Thereafter the program comes to the END.

The control signals $S_3$ and $S_4$ are fed to the actuators 242 and 254 of the pressure regulating valve 200. Referring back to FIG. 3, the actuators 242 and 254 are respectively responsive to the control signals $S_3$ and $S_4$ to control the ratios of energized period and deenergized period thereof. In the energized period, the actuator 242 pulls the valve member 234 away from the valve seat 238 against the pressure of the spring 256. Thus, the atmospheric air in the chamber 208 is introduced into the chamber 202. On the other hand, the chamber 202 constantly introduces the intake vacuum in the chamber 212. The vacuum pressure in the chamber 212 is maintained at a constant value by the opening and closing of the valve 222. Namely, the vacuum pressure in the chamber 212 is determined by the pressure difference of the springs 224 and 226 at a constant value. Therefore, the pressure in the chamber 202 is determined by the value of the atmospheric pressure from the chamber 208. The regulated vacuum pressure in the chamber 202 is fed to the chamber 144 of the main air control valve 122 to control the throttling ratio of the valve member 148 with respect to the valve seat 150. In relatively high altitude areas, the open ratio of the valve member 234 with respect to the valve seat 238 is increased due to increasing of the difference of the reference value $V_{ref}$ and the pressure signal value P. The increase in the difference value thus causes an increase in atmospheric air amount. As a result the throttle ratio (opening) of the valve member 148 is increased to increase air flow amount to be supplied to the induction passage 16.

Likewise, the actuator 254 of the pressure regulating valve 200 is responsive to the control signal $S_4$ to open the valve member 244 with respect to the valve seat 248. The chamber 204 is thus communicated with the chamber 208 which exposes it to atmospheric air during a period in which the valve member 244 opens. The chamber 204 also communicates with the chamber 212 to introduce therefrom the constant vacuum pressure. Thus, the vacuum pressure in the chamber 204 depends on the ratio of open period and close period of the valve member 244. If the pressure signal value P is less than the reference value $V_{ref}$, the duty cycle of the control signal $S_4$ is increased to increase the open period of the valve member 244. By this, the pressure to be fed to the chamber 164 of the slow air control valve 132 is increased to increase throttling ratio (opening) of the valve member 168 with respect to the valve seat 170.

As above-explained, the control system according to the present invention can effectively compensate air flow amount through main and slow air passages so that it prevents the air/fuel mixture from becoming too rich and can maintain the air/fuel ratio at a range where the catalytic converter works effectively.

Figure 6:
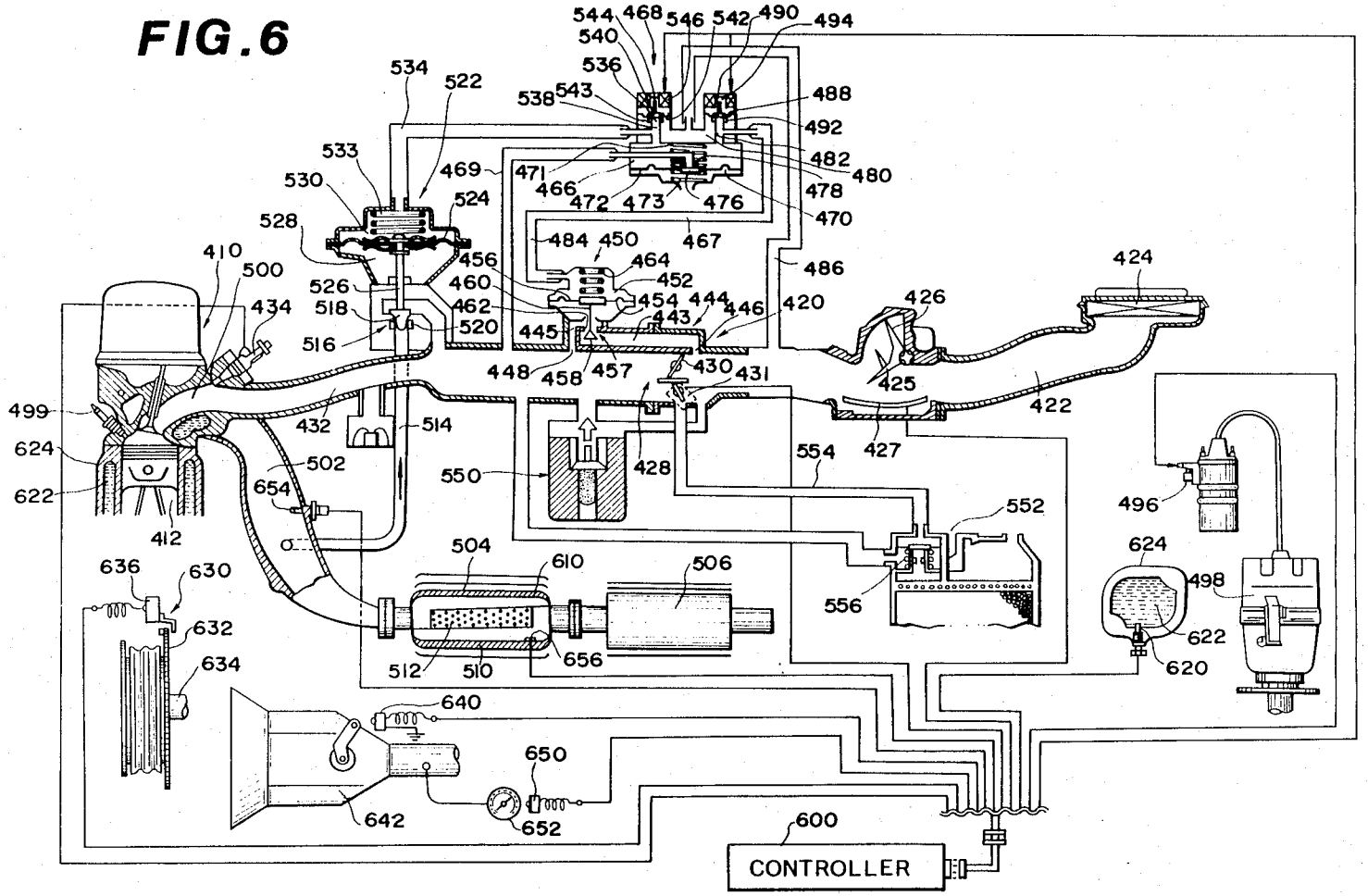
FIG. 6 is a fragmental diagramatic illustration of a fuel injection internal combustion engine having a fuel injection amount control system of the second embodiment of the present invention.

Referring to FIG. 6, there is illustrated a fuel injection internal combustion engine having an electromagnetically-operable fuel injection valve. Also, the engine control system for the fuel injection internal combustion engine is schematically illustrated with various sensors for determining the engine operating condition and for producing sensor signals representative of corresponding engine control parameters. The control system according to the present invention is schematically shown in the form of a diagram as applied to this internal combustion engine, as an example and for the purposes of explanation only, and should not be taken as limitative of the scope of the present invention to the control system applied to this specific engine. It should be appreciated that the system according to the present invention will be applicable to any type of internal combustion engine which can be controlled by a microcomputer mounted on the vehicle.

In FIG. 6, each of the engine cylinders 412 of an internal combustion engine 410 communicates with an air intake passage generally designated by 420. The air intake passage 420 comprises an air intake duct 422 with an air cleaner 424 for cleaning atmospheric air, an air flow meter 426 provided downstream of the air intake duct 422 to measure the amount of intake air flowing therethrough, a throttle chamber 428 in which is disposed a throttle valve 430 cooperatively coupled with an accelerator pedal (not shown) so as to adjust the flow rate of intake air flowing therethrough, and an intake manifold 432 having a plurality of conduits not clearly shown in FIG. 6. The air flow meter 426 comprises a flap member 425 and a rheostat 427. The flap member 425 is pivotably provided in the air intake passage 420 so that it can be pivotted through the cross-section thereof to vary its angular position with respect to air flow, corresponding to an air flow amount. Namely, if the flap member 425 is rotated clockwise in FIG. 6, the measured air flow amount increases. The rheostat 427 opposes the flap member 425 and generates an analog signal indicative of the air flow rate. The rheostat 427 is connected to an electric power supply and its resistance value varies in accordance with the air flow rate. A throttle angle sensor 431 is connected to the throttle valve 430. The throttle angle sensor 431 is adapted to measure an angular position of the throttle valve 430. The throttle angle sensor 431 produces an analog signal which referred as throttle angle signal $S_a$ hereafter, having value proportional to open angle of the throttle valve. The throttle angle sensor 431 comprises, for example, a potentiometer variable the resistance value according to varying of throttle valve angular position. The fuel injection amount flowing through the fuel injector 434 is controlled by an electromagnetic actuator (not shown). The actuator is electrically operated by the control system which determines fuel injection amount, fuel injection timing, and so on, according to engine operating conditions based on engine operation parameters such as engine load, engine speed, and so on.

It should be noted that, although the fuel injector 434 is disposed in the intake manifold 432 in the shown embodiment, it is possible to locate it in the combustion chamber 412 in a per se well-known manner.

A bypass passage 444 is provided for the intake air passage 420. One end 446 of the bypass passage 444 opens between the air flow meter 426 and the throttle valve 430 and the other end 448 opens downstream of the throttle valve 430, near the intake manifold 432. Thus the bypass passage 444 bypasses the throttle valve 430 and connects the intake air passage 420 upstream of the throttle valve 430 to the intake manifold 432. An idle control valve, designated by 450, is provided in the bypass passage 444. The idle control valve 450 comprises two chambers 452 and 454 separated by a diaphragm 456. The bypass passage 444 is thus separated by the valve means 450 into two portions 443 and 445 respectively located upstream and downstream of the port 457 of the valve 450. The valve means 450 includes a poppet valve 458 disposed within the port 457 in such a manner that it is movable between two positions, one position opening the valve to establish communication between the portions 443 and 445 of the passage 444 and the other closing the valve to block the communication therebetween. The poppet valve 458 has a stem 460 whose end is secured to the diaphragm 456 so as to cooperatively move therewith. The diaphragm 456 is biased downwards in the drawing, so as to release the poppet valve 458 from a valve seat 462, by a helical compression coil spring 464 disposed within the chamber 452 of the valve means 450. Thereby, the valve 450 is normally opened, and normally connects the portions 443 and 445 of the bypass passage 444 to one another, via its valve port 457.

The chamber 454 of the idle control valve 450 is opened to the atmosphere to introduce atmospheric air thereinto. On the other hand, the chamber 452 of the idle control valve 450 communicates with a pressure regulating valve 468, acting as a control vacuum source, through a vacuum passage 467. The pressure regulating valve 468 is separated into two chambers 466 and 470 by a diaphragm 472. The chamber 466 of the pressure regulating valve 468 also communicates with the intake air passage 420 downstream of the throttle valve 430 through the vacuum passage 469 so as to introduce intake vacuum. The chamber 470 is open to the atmosphere in a per se well-known manner. To the diaphragm 472 is secured a valve member 476 which opposes a valve seat 478 provided at the end of a passage 474. In the chambers 466 and 470 are disposed helical compression springs 471 and 473 respectively. The springs 471 and 473 are of approximately equal spring pressure in the neutral position of the diaphragm 472. It will be noted that the chamber 466 can also be connected with an exhaust-gas recirculation (EGR) control valve 516 which recirculates part of the exhaust gas flowing through an exhaust passage 502 and exhaust recirculation passage 514 to the intake manifold 432.

The diaphragm 472 is moved upwards or downwards by changes of the balance between the vacuum in the chamber 466 and the atmospheric pressure introduced into the chamber 470. According to the motion of the diaphragm 472, the valve member 476 is moved toward or away from the valve seat 478.

Another chamber 480 is also defined in the control valve 468, which communicates with the chamber 466 through a passage 482. The passage 482 is connected with the chamber 452 of the idle control valve 450 through a control vacuum passage 467. On the other hand, the chamber 480 further communicates with the air intake passage 420 upstream of the throttle valve 430 through a passage 486 so as to introduce atomospheric air. The chamber 480 is partitioned by a diaphragm 488 on which a magnetic valve member 490 is secured. The magnetic valve member 490 opposes a valve seat 492 formed at the end of the passage 482. Also, the magnetic valve member 490 opposes an electromagnetic actuator 494, the frequency and duration of energization of which is controlled by a control pulse signal generated by a controller 600. Depending on the amount of atmospheric air introduced into the passage 482 from the chamber 480, which is determined by the ratio of energized period to deenergized period of the electromagnetic actuator 494, the control vacuum for controlling the opening degree of the valve member 458 of the idle control valve 450 is regulated and supplied to the control valve through the control vacuum passage 467.

Spark ignition plugs 499 are inserted into respective engine cylinders 412 to effect ignition at controlled times. The ignition plug 499 is connected to an ignition coil 498 which receives electric power from a distributor 496.

An exhaust system for the engine exhaust gas comprises an exhaust manifold 500, an exhaust passage 502, an exhaust gas purifier 504, a silencer 506, and an exhaust nozzle 508. The exhaust manifold 500 opens toward the engine cylinders to receive engine exhaust gas therefrom. The exhaust passage 502 communicates with the exhaust manifold 500 and the exhaust gas purifier 504 and the silencer 506. In the shown embodiment, the exhaust gas purifier 504 comprises a purifier housing 510 and a three-way catalyst 512 disposed within the purifier housing 510. The three-way catalyst 512 oxidizes monoxide carbon CO and hydrocarbons HC and reduces nitrogen oxides $NO_x$.

An exhaust gas recirculation passage 514, which is referred to hereinafter as EGR passage is connected to the exhaust passage 502 upstream of the exhaust gas purifier 504. The EGR passage 514 communicates with the intake manifold 432 via an exhaust gas recirculation rate control valve 516 which is hereinafter referred to as EGR control valve. The EGR control valve 516 comprises a valve member 518 with a valve seat 520 which is provided at the end of the EGR passage 514 near the intake manifold 432. The valve member 518 is incorporated in a vacuum actuator 522 and is cooperatively connected with a diaphragm 524 of the vacuum actuator 522 via a stem 526. The diaphragm 524 divides the interior of the vacuum actuator 522 into two chambers 528 and 530. The chamber 528 communicates with the atmospheric air, and the chamber 530 communicates with the regulating valve 468 via a control vacuum passage 534 and contains a set spring 533. The control vacuum passage 534 joins a passage 536 connecting the vacuum chamber 466 with a chamber 538. One end of the passage 536 faces a valve member 540 secured on a diaphragm 542. A valve seat 543 is provided on the end of passage 536 to sealingly receive the valve member 540. The valve member 540 has a stem portion 544 inserted into an electromagnetic actuator 546.

The movement of the valve member 540 with respect to the valve seat 543 is controlled by the electromagnetic actuator 546. The duty cycle of the electromagnetic actuator 546 is determined by a control signal from a controller 600 described later. By the motion of the valve member 540, the intake air is admitted to the passage 536 via the passage 486 at a controlled amount. The intake air admitted into the passage 536 is mixed with the intake vacuum admitted from intake passage 420 downstream of the throttle valve 430 via the vacuum induction passage 469 into the vacuum chamber 466, so as to produce the control vacuum. The control vacuum thus produced is fed into the chamber 530 of the actuator 522 via the control vacuum passage 534 to control the opening and closing of the EGR control valve 516. Thereby, exhaust gas is admitted into the intake manifold 432 at a controlled rate.

An air regulator 450 is provided near the throttle chamber 428 for regulating the flow of intake air bypassing the throttle valve 430. Also, a carbon canister 552 is provided along a purge line 554. The carbon canister 552 retains hydrocarbon vapor until it is purged by air flowing through the purge line 554 to the intake manifold 432 when the engine is operated. When the engine is idling, the purge control valve 556 is closed. Only a small amount of purge air flows into the intake manifold 432 through the constant purge orifice. As engine speed and the intake vacuum increase, the purge control valve 556 opens and hydrocarbon vapor is sucked into the intake manifold 32 through both the fixed orifice and the constant purge orifice. Thus, the carbon canister 552 can reduce the emission of hydrocarbons by activation of charcoal therein.

Figure 7:
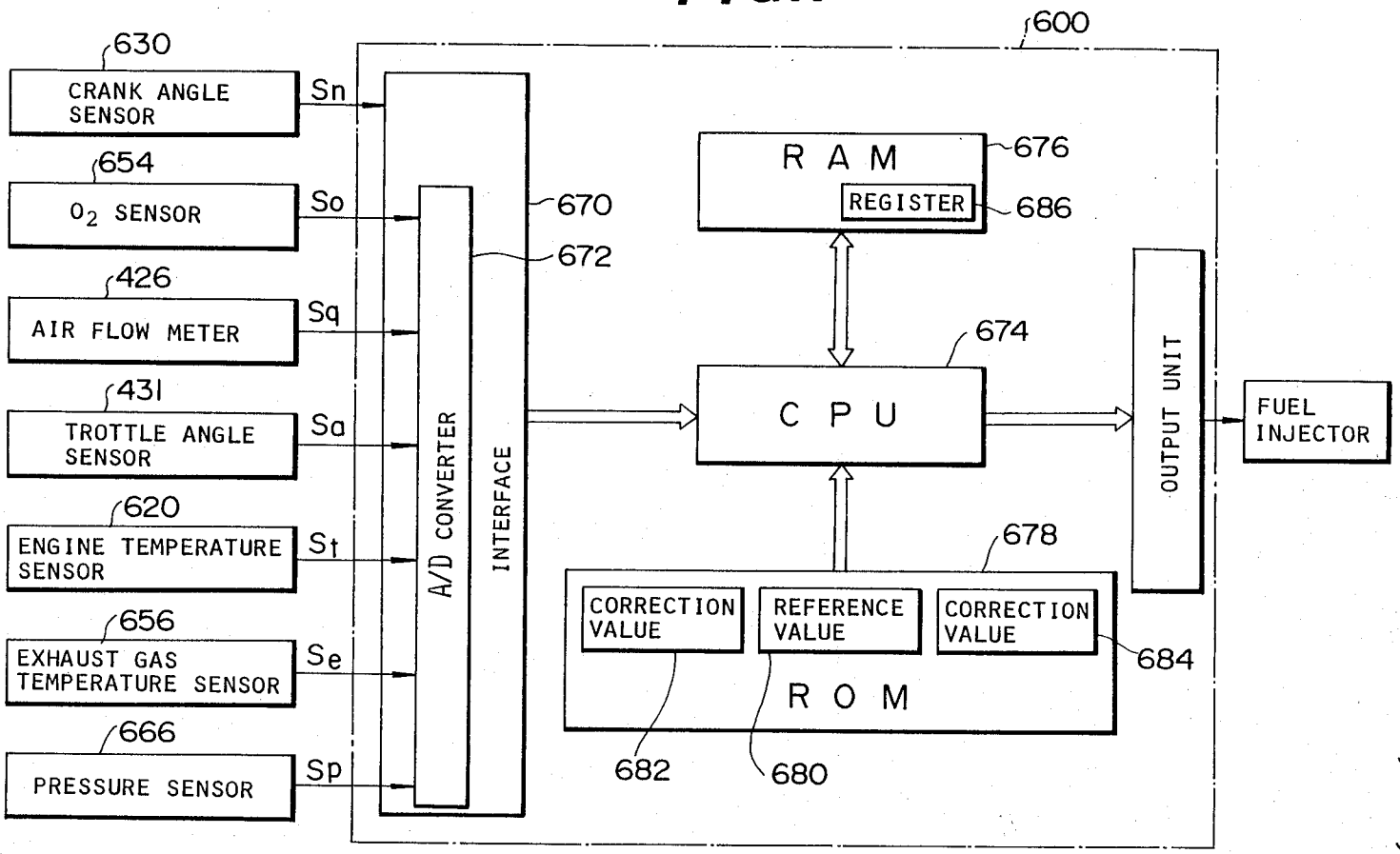
FIG. 7 is a schematic block diagram of the control system of FIG. 6.

As shown in FIGS. 6 and 7, the controller 600 generally comprises a CPU 674 and controls the fuel injection system, spark ignition system, EGR system, and the engine idle speed. The controller 600 is connected to an engine coolant temperature sensor 620. The engine coolant temperature sensor 620 is inserted into a coolant chamber 622 in an engine cylinder block 624 to determine the engine coolant temperature. The engine coolant temperature sensor 620 produces an engine coolant temperature signal indicative of the determined engine coolant temperature. The engine coolant temperature signal is an analog signal having a signal value proportional to the determined engine coolant temperature and is converted into a digital signal to make it compatible to the CPU 674 by an analog-digital converter 672.

In general construction, the engine coolant temperature sensor 620 comprises a thermistor fitted onto a thermostat housing 626 provided in the coolant circulation circuit.

A crank angle sensor 630 is also connected to the controller 600. The crank angle sensor 630 generally comprises a signal disc 632 secured onto a crank shaft 634 for rotation therewith, and an electromagnetic pick-up 636. The crank angle sensor 630 produces a crank reference angle signal and a crank position angle signal. As is well-known, the crank reference angle signal is produced when the engine piston reaches a predetermined position, e.g. 70 degree before the top dead center and the crank position angle signal is produced per a given crank rotation angle, e.g., per 5 degree of crank rotation.

A transmission neutral switch 640 is connected to the controller 600. The transmission neutral switch 640 is secured to the power transmission 642 to detect the neutral position thereof and produces a neutral signal when the transmission neutral position is detected.

Also, a vehicle speed sensor 650 is connected to the controller 600. The vehicle speed sensor 650 is located near a vehicle speed indicator 652 and produces a pulse signal as a vehicle speed signal having a frequency proportional to the vehicle speed.

In the exhaust passage 502, there is provided an exhaust gas temperature sensor 656 in the exhaust gas purifier 504. The exhaust gas temperature sensor 656 determines the exhaust gas temperature and produces an analog signal as an exhaust gas temperature signal, which has an analog signal value proportional to the determined exhaust gas temperature. The exhaust gas temperature signal is fed to the analog-digital converter 672 of the controller 600, in which the exhaust gas temperature signal is converted into the digital signal. The digital signal indicative of the exhaust gas temperature has a frequency corresponding to the analog value of the exhaust gas temperature signal. On the other hand, an exhaust gas sensor, 654 such as oxygen sensor hereinafter simply referred as $O_2$ sensor 654, is provided in the exhaust passage 502 upstream of the opening end of the EGR passage 514. The $O_2$ sensor 654 determines the concentration of oxygen in the exhaust gas. The output of the $O_2$ sensor becomes high when the determined oxygen concentration is less than that of the stoichiometry and becomes low when the oxygen concentration is more than that of the stoichiometry. The output of the $O_2$ sensor 654 is inputted to the controller 600 via the analog-digital converter 672 as a λ-signal.

Further, the air flow meter 422 is connected to the controller 600. The rheostat 427 of the air flow meter 426 outputs an analog signal having a signal value proportional to the determined intake air flow rate. The throttle angle sensor 431 is also connected to the controller 600 to supply the outputs of the full throttle switch and the idle switch. A pressure sensor 666 is provided in the intake manifold 432 to measure an intake manifold absolute pressure. The pressure sensor 666 produces an analog form pressure signal to be fed to the controller 600.

For controlling the fuel injection amount under stable engine conditions, which can be determined from the intake air flow rate indicated by the air flow meter 426, the engine speed indicated by the engine speed signal $S_N$, the throttle valve angle position detected by the throttle angle sensor 431, the vehicle speed indicated by the vehicle speed signal and so on, the $O_2$-sensor signal fed from the $O_2$ sensor 654 is used. Under stable engine conditions, the fuel injection amount is feedback controlled on the basis of the $O_2$ sensor signal so that the air/fuel ratio can be maintained near a stoichiometric value, such control being called λ-control. If the engine conditions are not stable, the fuel injection amount is generally determined on the basis of engine speed and intake air flow rate, the latter of which can be replaced by intake vacuum as measured downstream of the throttle valve. Under unstable engine conditions, the basic fuel injection amount determined on the basis of engine speed and air flow rate is corrected according to other parameters such as air-conditioner switch position, the transmission gear position, the engine coolant temperature and so on.

Generally, the controller 600 effects either of CLOSED-LOOP or OPEN-LOOP control depending on the engine operating condition. CLOSED-LOOP control is effected when the $O_2$ sensor effectively works in the normal exhaust gas temperature range so that the air/fuel ratio can be controlled at a stoichiometric value based on the $O_2$ sensor signal. CLOSED-LOOP control is disabled when the engine operating condition is not satisfactorily stable, e.g., when the engine temperature is lower than a normal engine temperature, engine is accelerating or decelerating. In the CLOSED-LOOP disabling condition, OPEN-LOOP control is effected. The controller 600 determines the basic fuel injection amount based on the engine speed and intake air flow rate which represents the load condition on the engine. The basic fuel injection amount is corrected based on other engine operating parameters in order to adapt the fuel injection amount to the engine operating condition.

FIG. 7 shows explanatorily a block diagram of the fuel injection control system of the second embodiment of the present invention. The circuit construction of the control system will be described hereafter with functions thereof with reference to FIG. 8 in which is shown a flowchart of the control program. As shown in FIG. 7, the microcomputer as the controller 600 comprises an interface 670 including an analog/digital converter 672, a CPU 674, a RAM 676 and a ROM 678. The ROM 678 prestores a table of a reference value $V_{ref}$ at a section 680 to be compared with the pressure signal value P which pressure signal $S_p$ is produced by the pressure sensor 666 and value of which is proportional to the intake manifold absolute pressure. The reference value $V_{ref}$ is representative of the intake manifold absolute pressure under a predetermined atmospheric air pressure which is the atmospheric air pressure at sea level. The ROM further has sections 682 and 684 respectively storing tables of correction values. The table in the section 682 is read out according to the difference of the reference value $V_{ref}$ and the pressure signal value P. On the other hand, the table in the section 684 is read out according to the engine temperature signal T.

Figure 8:
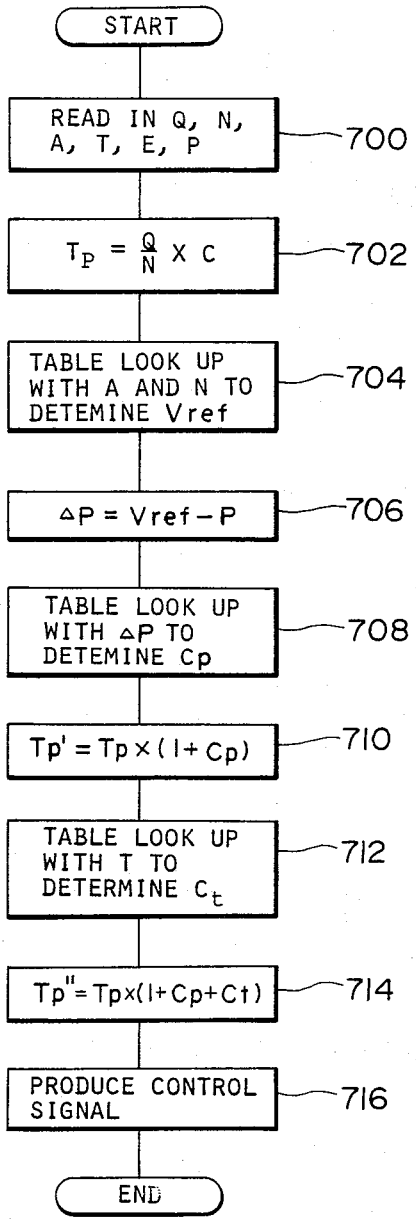
FIG. 8 is a flowchart of an OPEN LOOP control program for controlling the fuel injection amount including a correction depending on atmospheric air pressure.

The fuel injection OPEN-LOOP control program of FIG. 8 may be executed at a given timing, for example, in synchronism with the engine revolution. After START, the engine speed signal $S_n$ produced by the crank angle sensor 630 and the air flow meter signal $S_q$ are inputted to the CPU and the engine speed value N and the air flow meter signal Q are stored in a registers 686 of the RAM 676, at a block 700. Als, the value A of the throttle angle signal $S_a$, the value T of the engine temperature signal $S_t$, the value E of the exhaust gas temperature signal $S_e$ and the value P of the pressure sensor signal $S_p$ are stored in the designated addresses in the RAM 676. At a block 702, the basic fuel injection amount $T_p$ is arithmetically obtained from $$T_p = Q/N \times C$$

where C is a constant, based on the engine speed signal value N and the air flow meter signal value Q. Thereafter, the throttle angle signal value A and the engine speed signal value N are read out. Based on the throttle angle signal value A and the engine speed signal N, the table in the section 680 is read out to determine the reference value $V_{ref}$, at block 704. The CPU 674 compares the determined reference value $V_{ref}$ with the pressure signal value P to obtain pressure difference $\Delta P$ at block 706. Based on the pressure difference $\Delta P$, the table in the section 682 of the ROM is looked up to obtain a correction value $C_p$ for the basic fuel injection amount for correcting in relation to the difference of the atmospheric air pressure and that at sea level, at a block 708. With the determined correction value $C_p$, the basic fuel injection value $T_p$ is corrected at a block 710 by $$T_p' = T_p \times (1 + C_p)$$

Thereafter, a correction value $C_t$ is determined by table look up with respect to the engine temperature signal value T, at block 712. With the correction value $C_t$, the corrected fuel injection amount $T_p'$ is corrected at a block 714, by $$T_p'' = T_p \times (1 + C_p + C_t)$$

Based on the corrected fuel injection amount $T_p''$, a control signal is generated having duty cycle representative of the determined fuel injection amount $T_p''$, at a block 716. The control signal is fed to the fuel injector 434 to control the fuel injection amount according to the duty cycle of the control signal.

Figure 9:
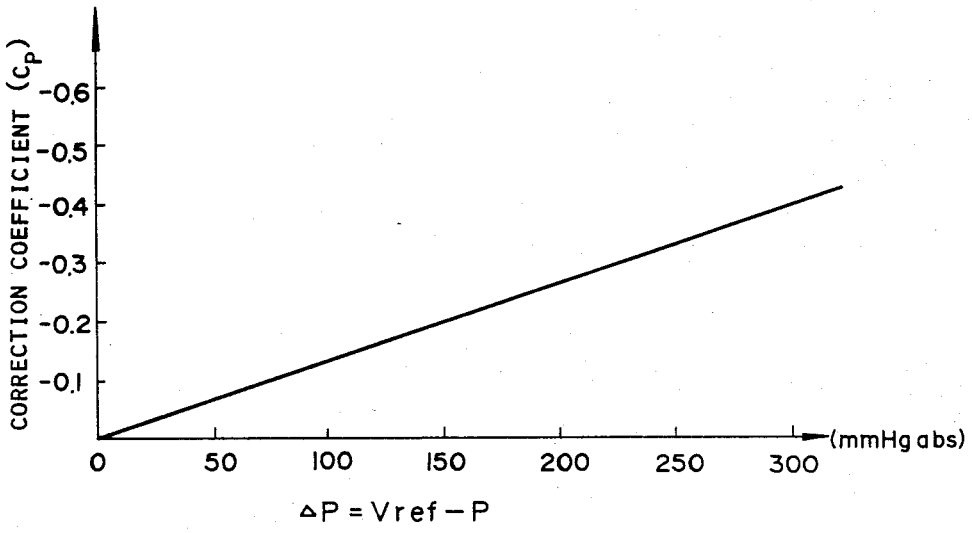
FIG. 9 is a graph showing the relationship of the pressure difference between the measured intake manifold absolute pressure represented by the pressure signal value P and the reference value $V_{ref}$ which corresponds the intake manifold absolute pressure at an area of 0 m level height from sea level, and the correction coefficient variable depending on the pressure difference.

The correction value $C_p$ is of the characteristic in relation to the pressure difference $\Delta P$ as shown in FIG. 9. As apparent from FIG. 9, the correction value $C_p$ is inversely proportional to the pressure difference $\Delta P$. Therefore, if the atmospheric air pressure drops, the fuel injection amount is reduced for preventing the air/fuel mixture from becoming too rich.

However correction of the OPEN-LOOP fuel injection amount is disclosed hereabove, the similar correction may be applied to CLOSED-LOOP control to keep the air/fuel ratio in a range where the air/fuel ratio can be controlled at stoichiometry.

As disclosed hereabove, the invention fulfills all of the objects and advantages sought thereto.

What is claimed is:

1. An air/fuel ratio control system for an internal combustion engine for controlling the air/fuel ratio in response to engine operating conditions, and for correcting the air/fuel ratio depending on atmospheric air pressure, comprising:

first means for detecting at least one of said engine operating conditions and producing a first signal indicative of the detected engine operating condition;

second means for measuring an intake manifold absolute pressure and producing a second signal representative of the measured intake manifold absolute pressure;

third means, responsive to said first signal, for determining a reference value signal to be compared with said second signal to obtain a difference value between the reference value signal and the second signal, said reference value signal having a value variable depending upon the value of said first signal and representative of an intake manifold absolute pressure;

fourth means, responsive to said difference value, for determining a correction value for said air/fuel ratio and producing a control signal having a value indicative of the corrected air/fuel ratio; and fifth means, responsive to said control signal, for controlling the engine air/fuel ratio.

2. An air/fuel ratio control system for an internal combustion engine for controlling the engine air/fuel ratio and for correcting the air/fuel ratio depending on atmospheric air pressure, said system comprising:

a first sensor for producing an engine load signal representative of load on the engine;

a second sensor for producing an engine speed signal representative of an engine revolution speed;

first means for detecting an engine operating condition based on said engine load signal and said engine speed signal to produce a first signal indicative of the detected engine operating condition;

second means for measuring an intake manifold absolute pressure and producing a second signal indicative of the measured pressure;

third means responsive to said first signal for determining a reference value to be compared with said second signal to obtain a difference signal; and fourth means responsive to said difference signal for producing a control signal for controlling the engine air/fuel ratio, said fourth means including a main and a slow air control valve, a main and a slow air induction valve including electromagnetically operative valve members respectively to introduce a controlled amount of air into said engine, a pressure regulator valve with an electromagnetically operable pressure regulating valve member, said main and slow air control valves each having a first chamber separated by a diaphragm from a second chamber, each of said first chambers connected with said pressure regulator valve for introducing therefrom a controlled vacuum pressure for controlling the throttling ratio of the main and slow air control valves with movement of said diaphragms, said fourth means producing said control signal for controlling said electromagnetically operative valve, said electromagnetically operable pressure regulating valve member responsive to said control signal for controlling the ratio of the energized period and deenergized period thereof, said pressure regulator valve producing a controlled pressure of vacuum for controlling the air delivery amount passing through said main and slow air control valves thereby controlling the air/fuel ratio to said engine.

3. An air/fuel ratio control system for an internal combustion engine for controlling the engine air/fuel ratio and for correcting the air/fuel ratio depending on atmospheric air pressure, said system comprising:

a first sensor for producing an engine load signal representative of load on the engine;

a second sensor for producing an engine speed signal representative of an engine revolution speed;

first means for detecting an engine operating condition based on said engine load signal and said engine speed signal to produce a first signal indicative of the detected engine operating condition;

second means for measuring an intake manifold absolute pressure and producing a second signal indicative of the measured pressure;

third means responsive to said first signal for determining a reference value to be compared with said second signal to obtain a difference signal said reference signal being derived on the basis of the value of said first signal and representative of an intake manifold absolute pressure; and fourth means responsive to said difference signal for producing a control signal for controlling the engine air/fuel ratio.

4. A system as set forth in claim 3, which further comprises a main and a slow air control valve, a main and a slow air induction valve including electromagnetically operative valve members respectively to introduce a controlled amount of air into said engine, a pressure regulator valve with an electromagnetically operable pressure regulating valve member, said fourth means producing said control signal for controlling said electromagnetically operative valve members, said electromagnetically operable pressure regulating valve member responsive to said control signal for controlling the ratio of the energized period and deenergized period thereof, said pressure regulator valve producing a controlled pressure of vacuum for controlling the air delivery amount passing through said main and slow air control valves thereby controlling the air/fuel ratio to said engine.

5. A system as set forth in claim 3, which further comprises a fifth means for determining a fuel injection pulse width based on preselected engine parameters, sixth means for correcting said fuel injection pulse width based on the control signal produced by said fourth means and generating a command signal, and an electromagnetically controlled fuel injection valve for injecting a controlled amount of fuel, which fuel injection valve is responsive to said command signal for energizing and deenergizing same to produce the duty cycle of the fuel injection pulse.

6. A method for controlling a metering amount of fuel to an induction system in an internal combustion engine, comprising steps of:

detecting a load condition on the engine;

detecting revolution speed of the engine;

detecting an absolute pressure of said induction system;

calculating a basic fuel metering amount based upon the detected engine load condition and the engine speed to derive a control signal for controlling a fuel metering means through which a controlled amount of fuel is supplied to said induction system;

calculating a standard absolute pressure in said induction system based on said engine load condition and said engine speed to derive a reference signal;

comparing said detected absolute pressure and said calculated standard absolute pressure to determine the difference therebetween;

deriving a correction value for said fuel metering amount based on the difference of detected absolute pressure and said calculated absolute pressure; and modifying said control signal value by said correction value to derive a modified control signal to control said fuel metering means by said modified control signal.

7. The method as set forth in claim 6, which further comprises the steps of detecting engine or engine coolant temperature and deriving a temperature dependent correction value based on the detected engine or engine coolant temperature for modifying the fuel metering amount.

8. The method as set forth in claim 7, in which said standard absolute pressure is derived by way of a table look up in terms of the engine load condition and the engine speed.

9. The method as set forth in claim 8, in which said pressure different dependent correction value is derived as a function of the difference between the detected absolute pressure and the calculated absolute pressure.

10. A fuel supply control system for an internal combustion engine including means for metering a fuel into an induction system of said engine, comprising:

an engine load detector producing an engine load signal having a value representative of a load condition on the engine;

an engine speed detector producing an engine speed signal having a value representative of a revolution speed of the engine;

a controller adapted to determine a fuel metering amount metered through said metering means based on said engine load signal value and said engine speed signal value, said controller producing control signals indicative of said fuel metering amount to control said fuel metering means for supplying a controlled amount of fuel to said induction system;

a pressure sensor producing a pressure signal having a value representative of an absolute pressure in said induction system;

a reference signal generator incorporated in said controller and producing a reference signal having a value indicative of a standard induction system absolute pressure determined based on said engine load signal value and said engine speed signal value;

means for comparing said pressure signal value with said reference signal value to obtain the difference therebetween to produce a difference indicative signal; and means for producing a correction signal for correcting said fuel metering amount based on said difference indicative signal value.

11. The system as set forth in claim 10, wherein said correction signal producing means derives a correction value as a function of said difference indicative signal value.

12. The system as set forth in claim 10, wherein said controller is responsive to said correction signal to modify the fuel metering amount determined based on said engine load signal value and said engine speed signal value for producing said control signal with modified fuel metering amount.

13. The system as set forth in claim 12, which further comprises an engine or engine coolant temperature sensor for producing a temperature signal having a value indicative of the temperature condition of the engine or engine coolant, and said controller is further responsive to said temperature signal for modifying the fuel metering amount depending upon a correction value derived based on said temperature signal value.

14. The system as set forth in claim 13, wherein said reference signal generator includes a memory storing a reference signal table to be looked up in terms of said engine load signal value and said engine speed signal value for deriving said reference signal value.

15. The system as set forth in claim 14, wherein said fuel metering means comprises a fuel injection system including means for determining a fuel injection pulse width based on preselected engine parameters, means for correcting said fuel injection pulse width based on said correction signal value and an electromagnetically controlled fuel injection valve for injecting a controlled amount of fuel, which fuel injection valve is responsive to said fuel injection pulse for energizing and deenergizing same to produce the duty cycle of the fuel injection pulse.

16. The system as set forth in claim 14, wherein said fuel metering means comprises an electronically controlled carburetor including a main and a slow air control valve, a main and a slow air induction valve including electromagnetically operative valve members respectively to introduce a controlled amount of air into said engine, a pressure regulator valve with an electromagnetically operable pressure regulating valve member, said controller producing said control signal for controlling said electromagnetically operative valve members, said electromagnetically operable pressure regulating valve member responsive to said control signals for controlling the ratio of the energized period and deenergized period thereof, said pressure regulator valve producing a controlled pressure of vacuum for controlling the air delivery amount passing through said main and slow air control valves thereby controlling the air/fuel ratio to said engine.

17. The system as set forth in claim 16, wherein said main and slow air control valves each have a first chamber separated by a diaphragm from a second chamber, each of said first chambers connected with said pressure regulator valve for introducing therefrom a controlled vacuum pressure for controlling the throttling ratio of the main and slow air control valves with movement of said diaphragms.

* * * * *